US006354131B1

(12) United States Patent
Pirchl

(10) Patent No.: US 6,354,131 B1
(45) Date of Patent: Mar. 12, 2002

(54) DEEP-DRAWING TOOL WITH INTEGRAL HOLDING-DOWN DEVICE

(76) Inventor: Gerhard Pirchl, Seestrasse 341, CH-5708 Birrwil (DE)

( * ) Notice: Subject to any disclaimer, the term of this patent is extended or adjusted under 35 U.S.C. 154(b) by 0 days.

(21) Appl. No.: 08/875,841

(22) PCT Filed: Feb. 6, 1996

(86) PCT No.: PCT/EP96/00485

§ 371 Date: Apr. 19, 1999

§ 102(e) Date: Apr. 19, 1999

(87) PCT Pub. No.: WO96/24449

PCT Pub. Date: Aug. 15, 1996

(30) Foreign Application Priority Data

Feb. 7, 1995 (DE) ..... 195 03 874

(51) Int. Cl.[7] ..... B21D 24/04
(52) U.S. Cl. ..... 72/351
(58) Field of Search ..... 72/350, 351

(56) References Cited

U.S. PATENT DOCUMENTS 682,866 A * 9/1901 Asche ..... 72/351
1,970,134 A * 8/1934 Ferris ..... 72/358
2,321,075 A * 6/1943 Frey et al. ..... 72/351
2,354,005 A * 7/1944 Flowers ..... 72/351
2,980,046 A * 4/1961 McGregor et al. ..... 72/350
4,745,792 A * 5/1988 Story et al. ..... 72/351
5,505,071 A * 4/1996 Hall, Jr. et al. ..... 72/350

FOREIGN PATENT DOCUMENTS

| | | |
|---|---|---|
| DE | 123718 | 9/1901 |
| DE | 2 146 461 | 3/1973 |
| EP | 0 344 386 A1 | 6/1988 |
| FR | 884771 | 5/1943 |
| JP | 4100639 | 4/1992 |

OTHER PUBLICATIONS 771b transactions of the ASME; Journal of Engineering for Industry; 112 (1990) Aug., No.3, New York, US; Deep Drawing with Blank Holder Force Approximately Proportional to the Punch Force.

* cited by examiner

*Primary Examiner*—Lowell A. Larson
(74) *Attorney, Agent, or Firm*—Fulbright & Jaworski L.L.P.

(57) ABSTRACT

A deep-drawing tool where the holding-down device is incorporated into the punch, and the holding-down device consists of individual punches uniformly on the circumference, where the punches are designed as elastomers.

3 Claims, 3 Drawing Sheets

DEEP-DRAWING TOOL WITH INTEGRAL HOLDING-DOWN DEVICE

TECHNICAL FIELD OF THE INVENTION

The field of the invention is a deep-drawing tool.

BACKGROUND OF THE INVENTION

The state of the art here is a deep-drawing tool which consists essentially of a punch, a holding-down device and a deep-drawing die.

In these prior art deep-drawing tools, the holding-down device is movable separately from the punch and is intended to sit on the metal sheet to be deep drawn and to hold this metal sheet down, while the punch moves simultaneously downward and pushes the metal sheet into the deep-drawing die, shaping it.

With the prior art holding-down devices, there is the disadvantage that holding-down devices are made of a metal which is impacted by a press of its own such that this metal sheet is held down with a relatively high pressure.

The design of the holding-down device with a press of its own (press punch) has, however, the disadvantage that the tool is very expensive and very costly to produce.

SUMMARY OF THE INVENTION

The object of the invention is thus to more economically produce a deep-drawing tool of the type mentioned at the beginning.

To achieve the object established, the invention is characterized by the technical teachings of claim 1.

An essential characteristic of the invention is that the holding-down device's is incorporated into the punch of the deep-drawing tool and is not impacted by a separate punch.

Provision is made in an improvement of the invention that the holding-down device is designed not as a ring, but rather that the holding-down device consists of individual punches disposed uniformly distributed on the circumference, which punches are designed as elastomers.

They are thus spring punches which preferably are made of an elastomeric material which has high resilience. Resilient attachment of the holding-down device is alternatively or additionally possible.

With it, the significant advantage is obtained that it is possible to do without a punch drive for the holding-down device, since according to the invention the holding-down device disposed in the punch itself. It has now been discovered that certain materials for the holding-down devices are best suited to generate an appropriate retaining force on the metal sheet to be secured, whereby this material is so highly deformable that with a simultaneously secured metal sheet (with a high hold-down pressure), the punch can penetrate into the necessary forming path in the die.

A polyurethane foam with a high resilience, of, for example, 50%, is preferably used as a material for the elastic body.

A plastic material which is adjustable with differing holding characteristics according to requirements is preferably used as the material for the brake shoes. Thus, for example, a polyethylene, a polyurethane, or the like may be used as the plastic material. Depending on the material used, a specific coefficient of friction is obtained upon contact with the metal sheet to be held.

The use of interchangeable cylindrical holding-down devices yields the significant advantage that according to requirements the holding-down devices, which are designed according to the invention as punches, are held interchangeably.

Thus, the type of holding-down device may be changed for a complex shaped deep-drawn part, in that, for example, holding-down devices with high resilience may be used on one side and holding-down devices with low resilience may be used on the other, such that high tension and thus a high retaining force is exerted on the deep-drawn part on the side with the holding-down devices with low resilience, whereas a lower retaining force is exerted on the deep-drawn part on the opposite side where the holding-down devices with high resilience are used.

In an additional embodiment of the invention, provision is made that the holding-down device is also provided with brake shoes, which brake shoes adapt to the deep-drawn part.

Thus, it is possible to alter the type and design of the brake shoes.

In a first embodiment, provision is made that each holding-down device (which is designed as a punch) is coordinated with its own brake shoe, which shoe corresponds to the cross-section of the holding-down device.

In another embodiment of the invention, provision is made that the brake shoe is designed as a surrounding ring on which the holding-down devices sit distributed piece by piece on the circumference. The retentive force may be altered by changing the type of material and the dimensions and the holding-down devices. For this, it is important that the brake shoes be able to elastically change shape slightly in order to be able to adapt to the surrounding edge of the deep-drawn part.

In the technical teaching reported, deep-drawing machines may thus be built very economically since it is possible to completely do without a dedicated drive for the holding-down device.

The object of the present invention results not only from the object of the individual claims but also from the combination of the individual claims with each other. All information and characteristics disclosed in the documents, including the abstract, in particular the spatial design depicted in the drawings are claimed as essential to the invention, to the extent they are new individually/or in combination compared to the state of the art.

BRIEF DESCRIPTION OF THE DRAWINGS

In the following, the invention is explained in detail with reference to drawings depicting only one embodiment mode. The drawings and their description disclose additional characteristics and advantages essential to the invention.

They depict

DETAILED DESCRIPTION OF THE INVENTION

Figure 1:
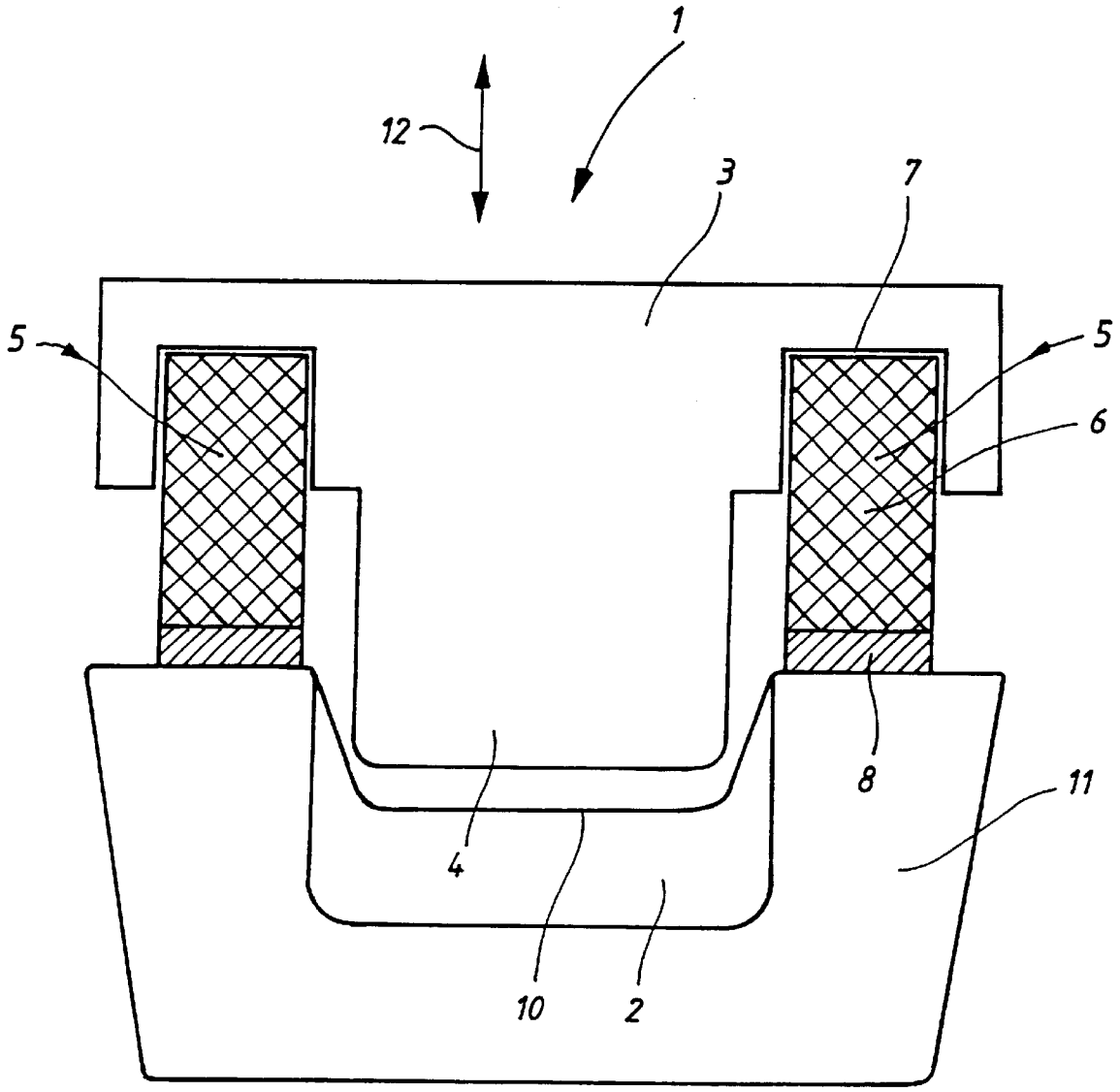
FIG. 1: a schematic cross-section through a deep-drawing tool in a first embodiment.

FIG. 1 depicts a deep-drawing tool 1, which consists in known fashion of a punch 3, which may be driven up and down in the directions of the arrow 12 and which carries a punch tool 4.

The punch tool engages in a forming hole 2 of a die 11 disposed under it, whereby a deep-drawing part 10 is to be deep-drawn by the punch tool 4. During this process, holding-down devices 5 sit on the deep-drawing part 10 on the edge zone around the forming hole 2, whereby each holding-down device is designed roughly like a punch, which punches may be round, rectangular, oval or of other shapes and preferably comprise an elastomeric body 6. The holding-down devices are preferably oblong and roughly cylindrical.

This elastomeric body should have a relatively high resilience to ensure that upon penetration of the punch 3 downward in the direction of arrow 12 the elastomeric body 6 is simultaneously so greatly deformed that it exerts a holding-down force on the deep-drawing part 10, but the elastomeric body 6 simultaneously shrinks in size since it is preferably formed from a plastic foam.

For further improvement of the holding-down force, provision may be made that a brake shoe 8 be formed on the bottom end of the respective elastomeric body 6, which shoe is either glued on as a separate plastic part or connected mechanically to the elastomeric body.

Provision may also be made that the brake shoe be connected in one piece with and in the same material as the elastomeric body and had been produced in the same foam process with a different hardness.

Here, it is also significant that it is possible to completely do without a separately driven holding-down device since the elastomeric bodies are disposed distributed piece by piece on the circumference.

Moreover, no distribution on an annular surface is required; instead, the elastomeric bodies may be disposed in their recesses 7 on the bottom end of the punch 3 in any order.

Likewise, the recesses 7 may be applied at different heights or with different depths with the same height of associated holding-down devices to influence the holding-down force at one point compared to that at another point.

By disposing the elastomeric bodies 6 in the associated recesses 7, they may be readily interchangeable and may be replaced according to requirements.

Figure 2:
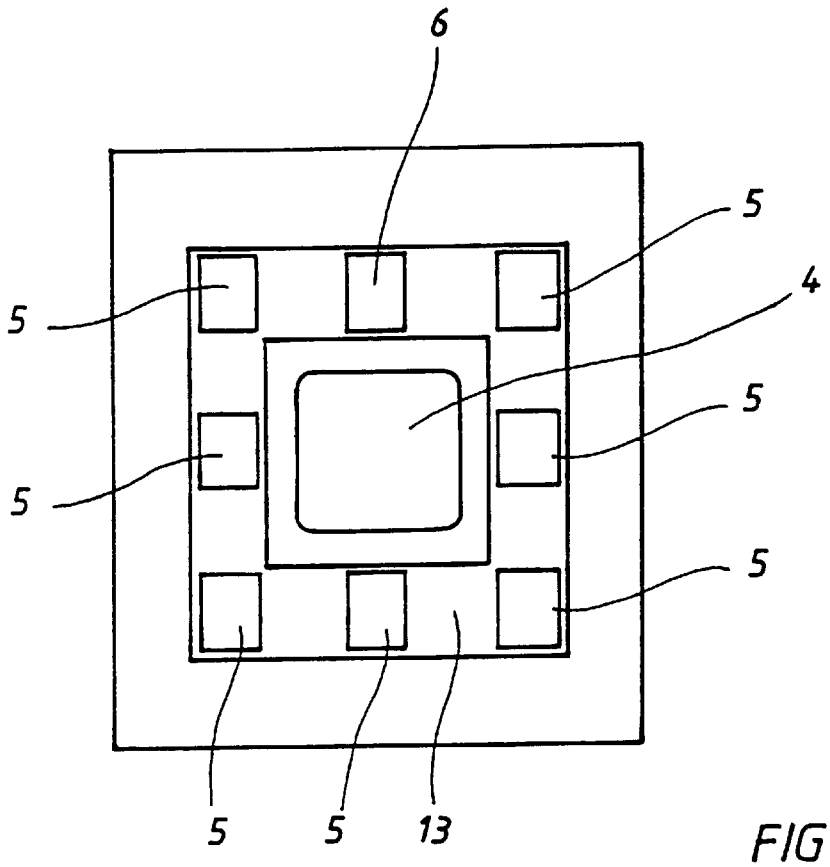
FIG. 2: a schematic top view of the punch.

FIG. 2 depicts that a surrounding groove 13 is formed around the punch 3, into which groove the aforementioned recesses 7 are formed to accommodate the holding-down devices 5.

Here, it may be seen that, for example, the holding-down devices are disposed in the shape of a square or a rectangle around the punch tool 4.

Figure 3:
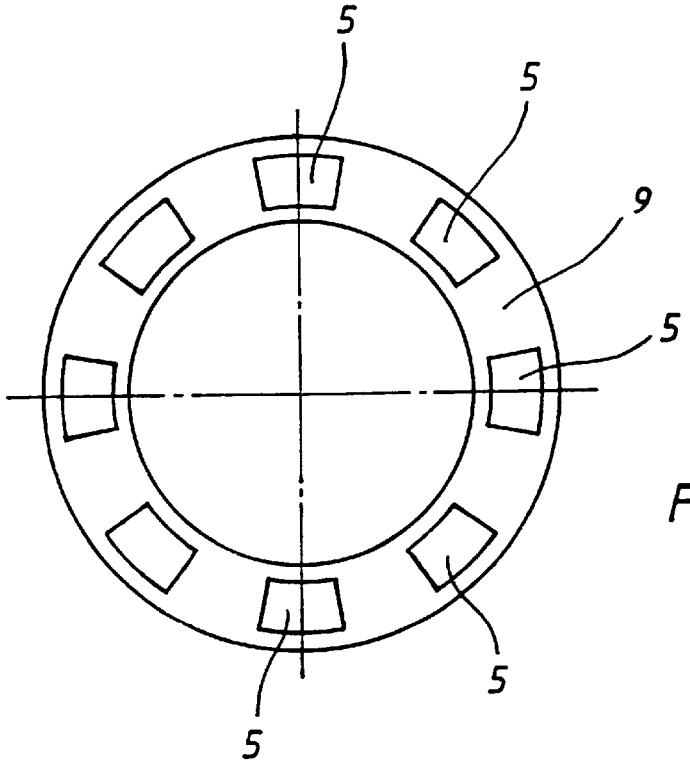
FIG. 3: a schematic of an embodiment with an annular brake shoe.

FIG. 3 depicts that the brake shoe may be formed not only piece by piece on the bottom end of the elastomeric body, but that the brake shoe may be designed as a brake shoe ring 9 on which the holding-down devices 5 sit. This brake shoe ring is preferably designed from an elastomeric plastic material, which adapts to the surrounding edge in the zone of the die 11.

Figure 4:
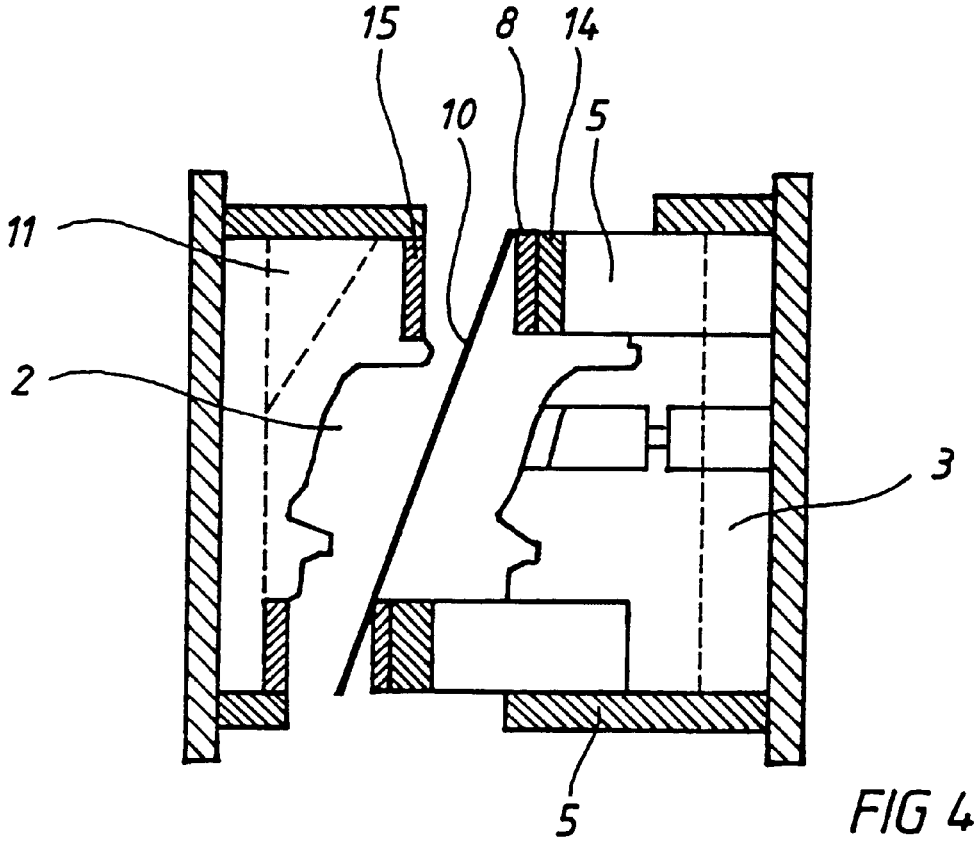
FIG. 4: a view corresponding to FIG. 1 through a deep-drawing tool in a second embodiment.
Figure 5:
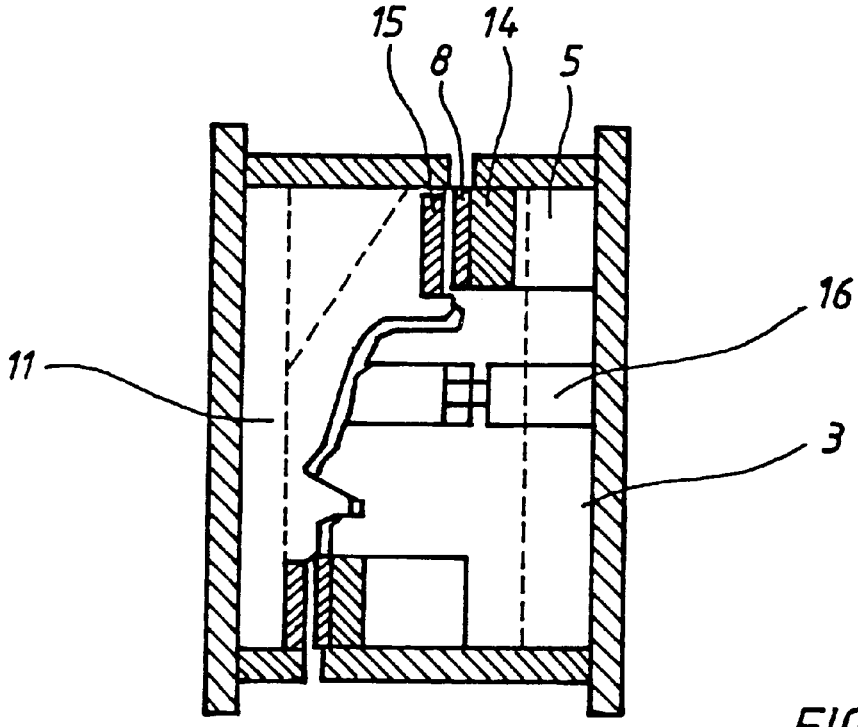
FIG. 5: the deep-drawing tool according to FIG. 4 in the closed state.

According to FIGS. 4, 5, an irregular distribution of the holding-down devices 5 in the punch 3 is also possible. The figures show that the holding-down devices 5 according to the invention do not absolutely have to be applied at the same height. It is, of course, not necessary to apply the holding-down devices in a circle; instead, any geometric shape may be selected.

In the exemplary embodiment depicted, the holding-down devices 5 are provided not only with a brake shoe 8, but also with an intermediate piece 14 which, like the brake shoe 8 may be produced together in one piece of the material with the holding-down device or produced separately from it and then attached in a suitable fashion. This intermediate piece may, for example, be used to adjust special compression and shock-absorbing characteristics of the holding-down device 5.

The die 2 is provided on the opposing point with a counter holder 15.

In the exemplary embodiment according to FIGS. 4, 5, provision is also made to shape the metal sheet in a first deep-drawing process and then, while the sheet is still in the die, to perform additional shaping using an additional punch 16.

For this, this additional punch 16 is mounted in the punch 3.

Thus, with the present invention an economically producible and flexibly useable deep-drawing tool is provided.

I claim:

1. A deep-drawing tool, comprising:

a plurality of hold-down devices, which are secured directly on a punch, and a die;

said hold-down devices being held exchangeably on the punch;

a hold-down device being comprised of a plurality of elastomer bodies wherein said bodies are selected from a group consisting of elastomer bodies of different elastomeric strengths;

a total desired elastomeric strength of a said hold-down device being formed by choosing a set of different elastomer bodies that total-up to said total desired elastomeric strength;

a said elastomer body of said set being held exchangeably on a said hold-down device.

2. A deep-drawing tool, comprising:

a plurality of hold-down devices, which are secured directly on a punch, and a die;

said hold-down devices being held exchangeably on the punch;

a said hold-down device being comprised of a plurality of elastomer bodies wherein said elastomer bodies are provided with a brake shoe;

a said brake shoe is selected from a group consisting of brake shoes with different braking abilities;

a total desired braking strength of a said hold-down device being formed by choosing a set of different brake shoes that total-up to said total desired brake strength;

a said brake shoe of said set being held exchange ably on a said hold-down device.

3. A deep-drawing tool, comprising:

a plurality of hold-down devices, which are secured directly on a punch, and a die;

said hold-down devices being held exchangeably on the punch;

a hold-down device being comprised of a plurality of elastomer bodies wherein said bodies are selected from a group consisting of elastomer bodies of different elastomeric strengths;

a total desired elastomeric strength of a said hold-down device being formed by choosing a set of different elastomer bodies that total-up to said total desired elastomeric strength;

a said elastomer body of said set being held exchangeably on a said hold-down device;

a said hold-down device being comprised of a plurality of elastomer bodies wherein said elastomer bodies are provided with a brake shoe;

a said brake shoe is selected from a group consisting of brake shoes with different braking abilities;

a total desired braking strength of a said hold-down device being formed by choosing a set of different brake shoes that total-up to said total desired brake strength;

a said brake shoe of said set being held exchangeably on a said hold-down device.

* * * * *